US010942001B1

(12) United States Patent
Lehr et al.

(10) Patent No.: US 10,942,001 B1
(45) Date of Patent: Mar. 9, 2021

(54) STOW PIN ACTUATOR

(71) Applicants: Matthew D. Lehr, King George, VA (US); Denver H. Walling, Bealeton, VA (US)

(72) Inventors: Matthew D. Lehr, King George, VA (US); Denver H. Walling, Bealeton, VA (US)

(73) Assignee: United States of America, as represented by the Secretary of the Navy, Arlington, VA (US)

( * ) Notice: Subject to any disclaimer, the term of this patent is extended or adjusted under 35 U.S.C. 154(b) by 0 days.

(21) Appl. No.: 16/837,310

(22) Filed: Apr. 1, 2020

(51) Int. Cl.
*F41A 23/50* (2006.01)

(52) U.S. Cl.
CPC ..... *F41A 23/50* (2013.01)

(58) Field of Classification Search
CPC ..... F41A 23/50; F41A 27/00; F41A 27/06; F41A 27/08; F41A 27/12
USPC ..... 89/37.11, 37.16
See application file for complete search history.

(56) References Cited

U.S. PATENT DOCUMENTS 2,395,893 A * 3/1946 Marlow ..... F41A 23/50 188/69
3,170,738 A * 2/1965 Winfree ..... F41A 23/50 384/420
5,062,347 A * 11/1991 Allais ..... F41A 27/08 89/37.07
8,434,397 B1 * 5/2013 Deckard ..... F41A 9/00 89/37.16

(Continued)

*Primary Examiner* — John Cooper
(74) *Attorney, Agent, or Firm* — Gerhard W. Thielman

(57) ABSTRACT

A stow pin is provided for locking and releasing a turret on a baseplate. The stow pin can be inserted into the turret for controllably engaging the baseplate. The stow pin includes a housing, a shaft, a tip, first and second inlets, first and second channels, and a piston. The housing encloses an axial bore with a piston cavity extending radially from the bore. The piston cavity has proximal and distal axial limits. The shaft is disposed in the bore to translate therealong, and has proximal and distal ends. The tip is disposed on the proximal end of the shaft for insertion into the baseplate. The first and second inlets receive fluid under pressure. The first channel transfers the fluid from the first inlet to the piston cavity at the proximal limit. The second channel transfers the fluid from the second inlet to the piston cavity at the distal limit. The piston is disposed on the shaft to translate axially within the piston cavity between the proximal and distal ends as respective engage and release positions. The fluid received in the first inlet and transferred to the first channel pushes the piston to the release position, while the fluid received in the second inlet and transferred to the second channel pushes the piston to the engage position. The tip engages the baseplate responsive to the piston being at the engage position, but released from the baseplate responsive to the piston being at the release position. Additionally, the stow pin can include a disk cavity, a disk, and proximal and distal sensors. The disk cavity is contained within the housing and extending radially from the axial bore. The disk connects to the shaft to translate axially within the disk cavity. The proximal and distal sensors connect to the disk corresponding to first and second disposal of said piston.

8 Claims, 2 Drawing Sheets

(56) References Cited

U.S. PATENT DOCUMENTS

2005/0072295 A1* 4/2005 Sulm ..... B60N 2/643
89/41.22

* cited by examiner

STOW PIN ACTUATOR

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to stow pins in relation to gimbals and turrets. In particular, the invention relates to a fluid controlled stow pin for remote engage and release of a gimballed weapon turret on a baseplate.

Within the science of gimbals and weapons turrets, a stow pin, also sometimes called a travel lock, is a device that immobilizes the azimuth or elevation axis to prevent rotation. This is done to prevent unwanted movement when the system is not in use, or as a safety feature while maintenance is being conducted. In some cases the stow pin is also used as a positional reference. The stow pin must be released before the system can be deployed.

In some systems, only manual control of the stow pin is provided. In this case, the operator must physically prepare the system for deployment or stowage by releasing or engaging the stow pin, as required. In applications where the system is in an unmanned area, for example on the top of a ship, this may be burdensome on the operator.

In some systems, only powered control of the stow pin is provided. In this case, the system will be inoperable in the event of an actuator failure, or loss of power. One desires in military equipment to, have a manual backup mode to avoid this possibility. Also, for safety reasons, the system's power may be intentionally secured prior to beginning maintenance. Often it is desired for the control system to detect the position of the stow pin, and to interlock stow pin release with train and elevation commands.

SUMMARY

Conventional stow pins yield disadvantages addressed by various exemplary embodiments of the present invention. In particular, various exemplary embodiments provide a stow pin for locking and releasing a turret on a baseplate. The stow pin can be inserted into the turret for controllably engaging the baseplate. The stow pin includes a housing, a shaft, a tip, first and second inlets, first and second channels, and a piston. The housing encloses an axial bore with a piston cavity extending radially from the bore. The piston cavity has proximal and distal axial limits. The shaft is disposed in the bore to translate therealong, and has proximal and distal ends. The tip is disposed on the proximal end of the shaft for insertion into the baseplate. The first and second inlets receive fluid under pressure. The first channel transfers the fluid from the first inlet to the piston cavity at the proximal limit. The second channel transfers the fluid from the second inlet to the piston cavity at the distal limit.

The piston is disposed on the shaft to translate axially within the piston cavity between the proximal and distal ends as respective engage and release positions. The fluid received in the first inlet and transferred to the first channel pushes the piston to the release position, while the fluid received in the second inlet and transferred to the second channel pushes the piston to the engage position. The tip engages the baseplate responsive to the piston being at the engage position, but released from the baseplate responsive to the piston being at the release position.

In alternate embodiments, the stow pin can include a disk cavity, a disk, and proximal and distal sensors. The disk cavity is contained within the housing and extending radially from the axial bore. The disk connects to the shaft to translate axially within the disk cavity. The proximal and distal sensors connect to the disk corresponding to first and second disposal of said piston.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Exemplary embodiments provide a pneumatic actuator to engage and release a stow pin. The embodiments are modular and can be adapted to different diameters and lengths of stow pins, and to operate with various manual override systems, as required by the particular application. Sensors within the invention provide feedback to a control system by indicating whether the stow pin is engaged, released, or jammed.

Figure 1A:
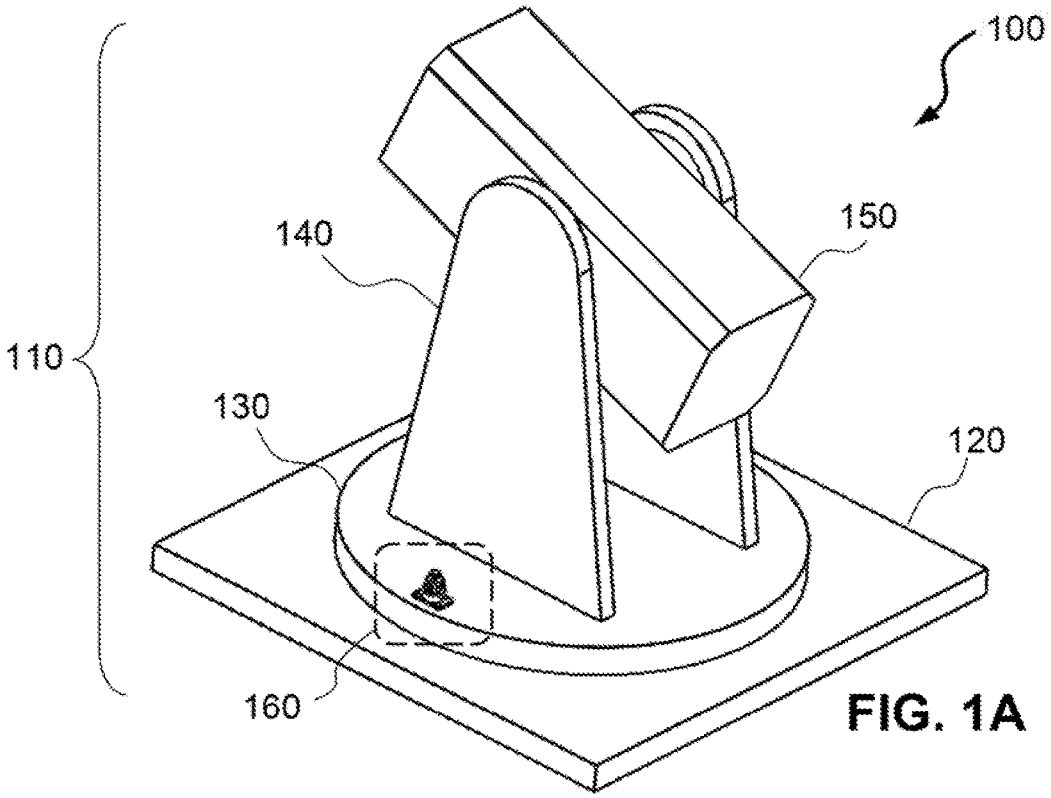
FIG. 1A is an isometric view of a weapon gimbal system.
Figure 1B:
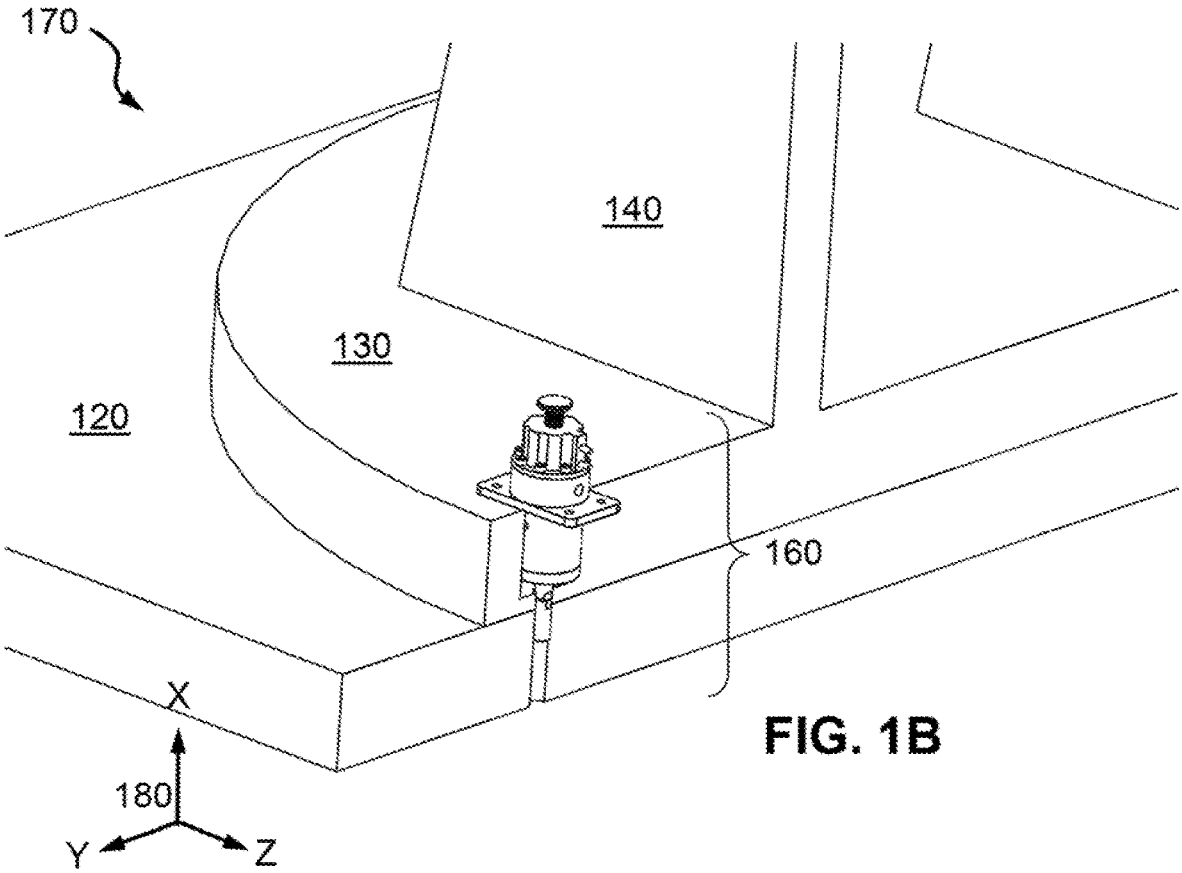
FIG. 1B is an isometric detail view of a stow pin in the system.

FIG. 1A shows an isometric view 100 of a gimballed weapons turret system 110. A baseplate 120 aboard a platform, such as a Naval combat vessel supports a gimbal turret 130 for lateral rotation. A pair of struts 140 mounted to the turret 130 support a weapon 150 for azimuth rotation. An exemplary stow pin assembly 160 can be used to releasably lock the turret 130. FIG. 1B shows an isometric detail view 170 of the stow pin 160 in context to a cross-section of the turret 130 on the baseplate 120. An exemplary stow pin 160 would be seven-to-nine inches in length, with a mass of two-to-five $lb_m$ and composed substantially of stainless steel and aluminum for a two ton system 110. A compass rose 180 features Cartesian directions as X: axial up, Y: lateral cross-section tangent, and Z: lateral cross-section normal.

Figures 2, 3A, 3B, 4:
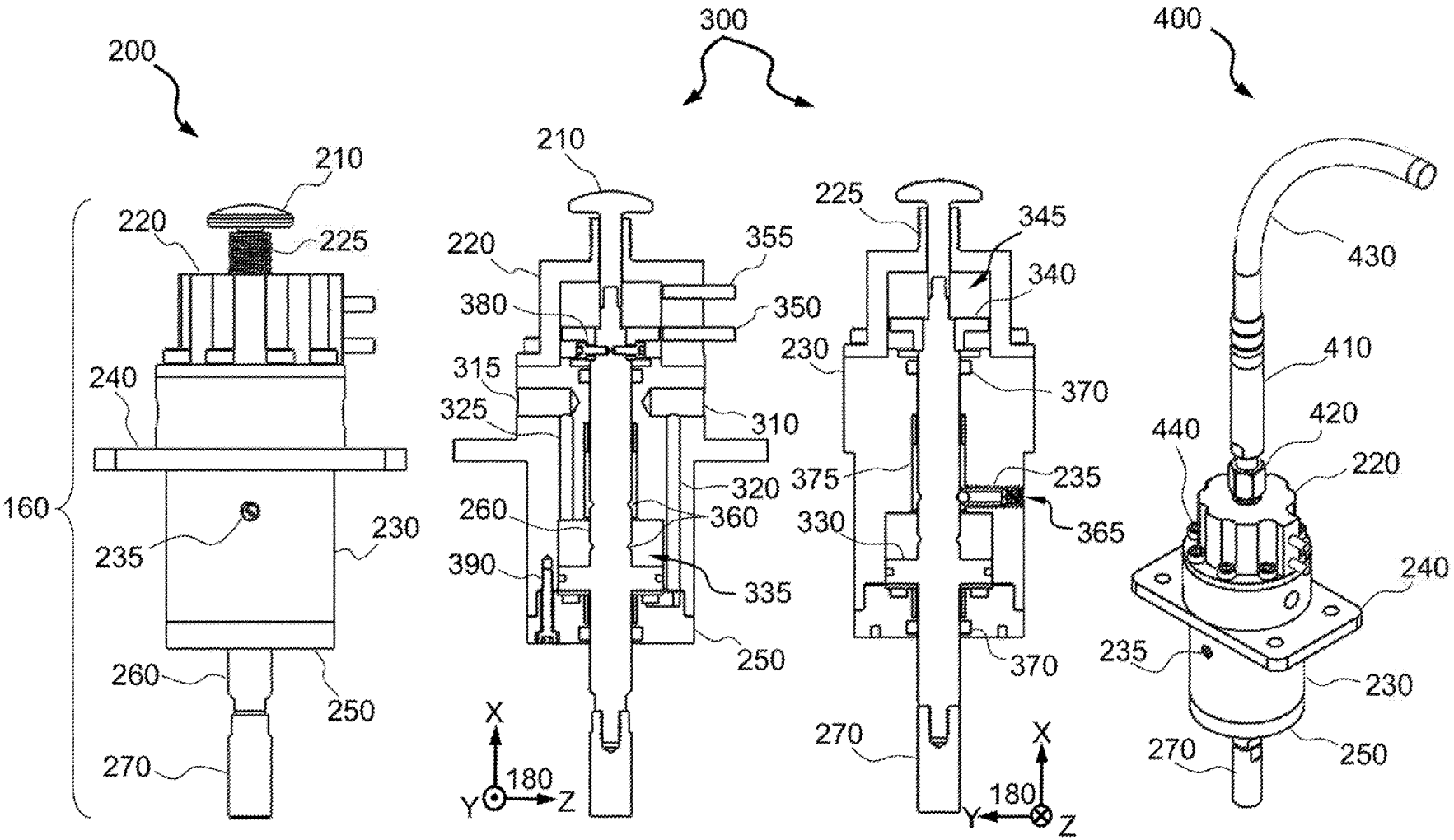
FIG. 2 is an elevation view of the exemplary stow pin.
FIGS. 3A and 3B are elevation cross-section views of the stow pin.
FIG. 4 is an isometric view of an alternative stow pin embodiment.

FIG. 2 shows an elevation view 200 of the exemplary stow pin 160, showing the relative positions and mating recess on the baseplate 120. The stow pin 160 is depicted in the stowage configuration, i.e., being engaged to inhibit rotation of gimbal of the turret 130. At the upper end, the stow pin 160 includes a manual control knob 210 and an upper (or distal) cap 220 with a threaded axial extension 225.

The mid-portion of the stow pin 160 includes a main housing 230 with a lateral detent 235, a ledge 240 and a lower (or proximal) cap 250. (Relative proximal and distal positions are in relation to the baseplate 120.) A shaft 260 axially inserts into the housing 230 through an axial bore and threads into the knob 210. At the lower end of the stow pin 160 opposite the knob 210, the shaft 260 threads into a tip 270. As shown, the ledge 240 represents an integral lateral extension of the housing 230 for a mounting surface to the turret 130, but alternative fabrication arrangements can be availed. The tip 270 can be tailored to insert into a corresponding receptacle of the baseplate 120.

FIGS. 3A and 3B show elevation cross-section views 300 of the exemplary stow pin 160 assembly in in the stowage configuration, such that the tip 270 inserts into the baseplate 120 and inhibits rotation of the turret 130. FIG. 3A provides illustration in the vertical X-Z plane (similar to view 200) while FIG. 3B features the vertical X-Y plane. Artisans of ordinary skill will recognize that the orientations described herein are exemplary, and not limiting.

Respective release and engage passage intakes 310 and 315 permit fluid from a control supply into actuator components of the stow pin 160 through corresponding channels 320 and 325. For respective pneumatic and hydraulic systems, the pressurized fluid can be either compressed gas (e.g., air) or liquid. A piston 330 extends radially from the shaft 260. The piston 330 translates axially (in the X direction) within a first cavity 335 between its limits, depending on the fluid from either the intakes 310 or 315.

The release channel 320 deposits the fluid from the intake 310 to the lower (proximal) limit of the cavity 335 to push the piston 330 up. The engage channel 325 deposits the fluid from the intake 315 to the upper (distal) limit of the cavity 335 to push the piston 330 down. For the disengage configuration, the shaft 260 rises with the piston 330 to remove the tip 270 from the baseplate 120, and thereby release the turret 130 to rotate in the horizontal Y-Z plane. For the stowage configuration, the shaft 260 descends with the piston 330 to insert the tip 270 into the baseplate 120, and thereby lock the turret 130 from rotating along its vertical axis (in the X direction).

A metallic disk 340 fixes to the shaft 260 and translates axially within a second cavity 345 of the upper cap 220. The disk 340 engages with either an engage position sensor 350 or else a release position sensor 355, depending on the relative position of the piston 330 within the first cavity 335. In this exemplary depiction, the position sensors 350 and 355 operate by inductive proximity, but contact switches could be alternatively incorporated. Note that circumstances in which the disk 340 fails to contact either the engage or release sensors 350 or 355 are indicative of a jam in the housing 230 of the stow pin 160.

The proximal and distal limits of axial travel by the shaft 260, and by extension the knob 210 correspond to annular notches 360, which engage the detent 235 within a threaded cavity 365. These respective limits for the upper and lower notches 360 correspond to the stowage (as depicted) and disengage configurations of the stow pin 160. The housing 230 also includes annular cavities 370 for O-rings to seal channels 320 and 325 along the shaft 260 as well as an annular gap 375 of the bore. The shaft 260 includes pin fasteners 380 to secure the disk 340. A threaded fastener 390 extends through the lower cap 250 to engage the housing 230 securely. Note that both cavities 335 and 345 extend radially from the bore, and are axially separate.

FIG. 4 shows an isometric view 400 of an alternative manual control embodiment for the stow pin 160. A flexible control rod 410 can be employed to manually pull and release the tip 270 to clear the baseplate 120 from a remote position. The control rod 410 proximally attaches to a nut 420 threaded to the extension 225 and distally attaches to a tube 430 for remote manual control. The upper cap 220 secures to the housing 230 by angularly distributed hex bolts 440.

Operation for release can be described as follows: To gimbal the weapon system 110, a control system supplies fluid to pressurize the release intake 310 in the exemplary stow pin 160. This causes the piston 330 to translate axially upward within the first cavity 335 of the housing 230. The shaft 260 moving up in the housing 230, thereby enables the tip 270 to disengage the mating receptacle of the baseplate 120. When the piston 330 reaches its upper limit, the detent 235 captures and restrains the shaft 260 at the lower of the notches 360. This connects the disk 340 to the release sensor 355, informing the control system of release procedure completion so that the turret 130 is free to rotate.

Operation for engagement can be described as follows: To gimbal the weapon system 110, a control system supplies fluid to pressurize the engage intake 315 in the exemplary stow pin 160. This causes the piston 330 to translate axially downward within the first cavity 335 of the housing 230. The shaft 260 moving down in the housing 230, thereby enables the tip 270 to insert into the mating receptacle of the baseplate 120. When the piston 330 reaches its lower limit, the detent 235 captures and restrains the shaft 260 at the higher of the notches 360. This connects the disk 340 to the engage sensor 350, informing the control system of engage procedure completion so that the turret 130 is restrained from rotation about its axis.

Manual operation is as follows: The operator pulls up on the control knob 210, which may be remotely located via a control rod 410 or linkage, causing the shaft, assembly to rise. At the end of travel, the detent 235 holds the shaft 260 in the disengage configuration. To stow the weapon system 110, the operator pushes down on the control knob 210 into the housing 230. This causes the shaft 260 to descend, and the tip 270 to insert into the receptacle of the baseplate 120.

Application of the technology of gimbaled weapon systems 110 enables the gimbal to have robust remote and local control, and to provide feedback to the gimbal control system on the status of exemplary pins 160. The stow pin 160 is modular and can be configured with a fitted tip 270 and/or manual access as applicable. Fluid pressure enables the stow pin 160 have a compact and lightweight form factor on the weapon system 110.

In conventional applications, stow pin designs with purely manual control are available, but these induce operator burden and hazard risk. Conventional designs can employ external sensors for feedback regarding a pin's position. However, this approach lacks the compact, integrated form factor of exemplary embodiments, and may be more prone to damage. Exemplary embodiments provide verification as to whether the stow pin 160 is in either engage or release configuration based on the disk 340 engaging their respective sensors 350 and 355.

Design modifications for the stow pin 160 can provide for the housing 230, upper cap 220 and lower cap 250 to be unitary. However, this arrangement is optional and may be less than ideal in the event of disassembly and repair in favor of the housing 230 constituting a mezzanine body. Moreover, for instances that discount manual override, the optional knob 210 can be omitted. Other alterations can be contemplated without departing from the scope of the invention.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A stow pin for locking and releasing a turret on a baseplate, said stow pin being insertable into said turret for controllably engaging said baseplate and comprising:

a housing enclosing an axial bore with a piston cavity extending radially from said bore, said piston cavity having proximal and distal axial limits;

a shaft disposed in said bore to translate therealong, said shaft having proximal and distal ends;

a tip disposed on said proximal end of said shaft for insertion into the baseplate;

first and second inlets for receiving fluid under pressure;

a first channel for transferring said fluid from said first inlet to said piston cavity at said proximal axial limit;

a second channel for transferring said fluid from said second inlet to said piston cavity at said distal axial limit;

a piston disposed on said shaft to translate axially within said piston cavity between said proximal and distal axial limits as respective engage and release positions, wherein said fluid received in said first inlet and transferred to said first channel pushes said piston to said release position, said fluid received in said second inlet and transferred to aid second channel pushes said piston to said engage position, and said tip engages the baseplate responsive to said piston disposal at said engage position, and otherwise responsive to said piston disposal at said release position.

2. The stow pin according to claim 1, further including:

a disk cavity contained within said housing and extending radially from said axial bore;

a disk connected to said shaft to translate axially within said disk cavity; and proximal and distal sensors for connecting to said disk corresponding to first and second disposal of said piston.

3. The stow pin according to claim 2, wherein said housing comprises a mezzanine body containing said piston cavity, and a distal cap containing said disk cavity.

4. The stow pin according to claim 1, further including a detent to restrain said shaft while said piston is disposed at one of said proximal and distal axial limits.

5. The stow pin according to claim 1, further including a flange on said housing for attaching to the turret.

6. The stow pin according to claim 1, further including a knob connecting to said shaft at said distal end to manually translate said shaft.

7. The stow pin according to claim 1, further including a flexible rod connecting to said shaft at said distal end to manually translate said shaft.

8. The stow pin according to claim 1, wherein said fluid is compressed air.

* * * * *